US005261577A

United States Patent [19]

Goldstein et al.

[11] Patent Number: 5,261,577

[45] Date of Patent: Nov. 16, 1993

[54] PAINT BRUSH CADDY

[76] Inventors: Gilbert Goldstein, 49 Huntingdon Dr., Churchville; Oscar Shapiro, 52 Summer Dr., Holland, both of Pa. 18966

[21] Appl. No.: 46,310

[22] Filed: Apr. 15, 1993

[51] Int. Cl.[5] ..... B65D 25/20

[52] U.S. Cl. ..... 220/697; 220/23.83; 220/736

[58] Field of Search ..... 220/697, 700, 736, 23.83, 220/23.86

[56] References Cited

U.S. PATENT DOCUMENTS

| | | | |
|---|---|---|---|
| 482,082 | 9/1892 | Deming et al. | 220/697 X |
| 1,644,612 | 10/1927 | Roberts | 220/23.83 |
| 2,314,835 | 3/1943 | Johns et al. | 220/23.83 X |
| 3,442,435 | 5/1969 | Ludder et al. | 220/23.83 X |
| 3,688,943 | 9/1972 | Brown | 220/23.83 X |
| 4,867,332 | 9/1989 | Mains | 220/23.83 X |
| 5,072,868 | 12/1991 | Dickie et al. | 220/736 X |
| 5,207,348 | 5/1993 | Fischer et al. | 220/700 X |

FOREIGN PATENT DOCUMENTS

| | | | |
|---|---|---|---|
| 2231550 | 11/1990 | United Kingdom | 220/736 |

*Primary Examiner*—Steven M. Pollard
*Attorney, Agent, or Firm*—S. Michael Bender

[57] ABSTRACT

A paint brush caddy adapted to hold a paint brush in association with a paint bucket and to prevent dripping from such brush onto the floor comprising in its basic elements a container into which the paint brush is inserted and which is enclosed to prevent leakage therefrom, and means to affix such container in a removable fashion to the lip of a paint bucket to hold the container in fixed position on said bucket.

2 Claims, 3 Drawing Sheets

FIG 1
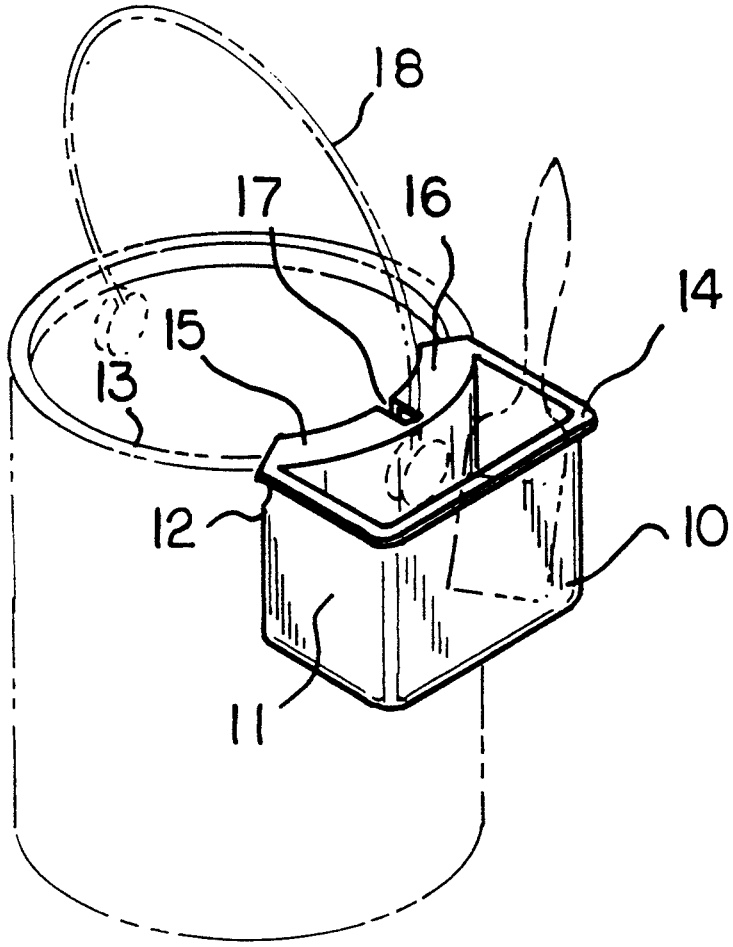
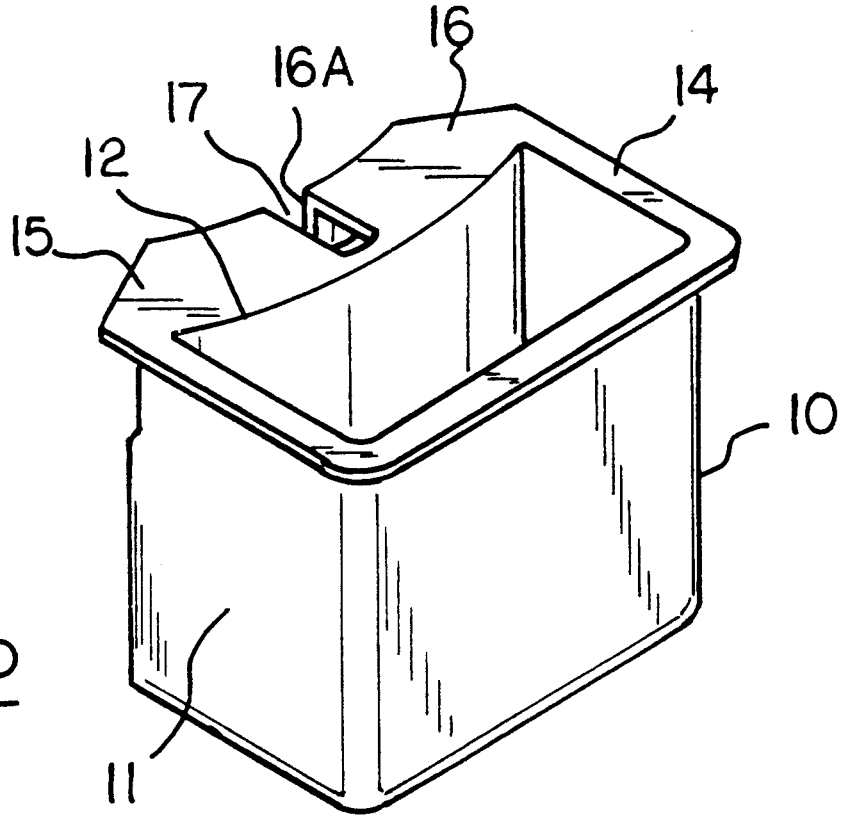
FIG 2

PAINT BRUSH CADDY

BACKGROUND OF THE INVENTION

1. Field of the Invention

The present invention relates to paint brush caddies and more particularly pertains to a paint brush caddy which may be used in conjunction with a conventional paint bucket.

2. Description of the Prior Art

The use of carrying devices for paint brushes is known in the prior art. More specifically, paint brush caddies heretofore devised and utilized for the purpose of supporting a paint brush are known to consist basically of familiar, expected and obvious structural configurations, notwithstanding the myriad of designs encompassed by the crowded prior art which have been developed for the fulfillment of countless objectives and requirements.

Prior art paint brush caddies have not been particularly convenient for the user—frequently sliding around on the rim of the paint bucket or requiring awkward movement of the hand to place the brush therein. Typical of such prior art devices are U.S. Pat. Nos. 5,038,955; 5,035,387; 4,927,046; 5,035,386; and 4,865,282.

In this respect, the caddy according to the present invention substantially departs from the conventional concepts and designs of the prior art, and in so doing provides an apparatus primarily developed for the purpose of conveniently supporting a paint brush both in use and otherwise.

Therefore, it can be appreciated that there exists a continuing need for new and improved paint brush caddies which can be user-friendly. In this regard, the present invention substantially fulfills this need.

SUMMARY OF THE INVENTION

In view of the foregoing disadvantages inherent in the known types of paint brush caddies now present in the prior art, the present invention provides an improved caddy. As such, the general purpose of the present invention, which will be described subsequently in greater detail, is to provide a new and improved paint brush caddy which has all the advantages of the prior art devices and none of the disadvantages.

To attain this, the present invention comprises a paint brush caddy adapted to hold a paint brush in association with a paint bucket and to prevent dripping from such brush onto the floor comprising in its basic elements a container into which the paint brush is inserted and which is enclosed to prevent leakage therefrom, means to affix such container in a removable fashion to the lip of a paint bucket to hold the container in fixed position on said bucket.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved paint brush caddy which has all the advantages of the prior art devices and none of the disadvantages.

It is another object of the present invention to provide a new and improved paint brush caddy which may be easily and efficiently manufactured and marketed.

It is a further object of the present invention to provide a new and improved paint brush caddy which is of a durable and reliable construction.

An even further object of the present invention is to provide a new and improved paint brush caddy which is susceptible of a low cost of manufacture with regard to both materials and labor, and which accordingly is then susceptible of low prices of sale to the consuming public, thereby making such devices economically available to the buying public.

Still yet another object of the present invention is to provide a new and improved paint brush caddy which provides in the apparatuses and methods of the prior art some of the advantages thereof, while simultaneously overcoming some of the disadvantages normally associated therewith.

Still another object of the present invention is to provide a new and improved device to minimize problems with paint brush dripping.

Yet another object of the present invention is to provide a new and improved paint brush caddy which can be positioned in a non-slip relationship on the lip of a paint bucket.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of the present invention showing the relation between a paint bucket and brush (broken lines) and the basic device of the present invention.

FIG. 2 is a perspective view of the simplest form of the device of the present invention.

DESCRIPTION OF THE PREFERRED EMBODIMENT

Figure 3:
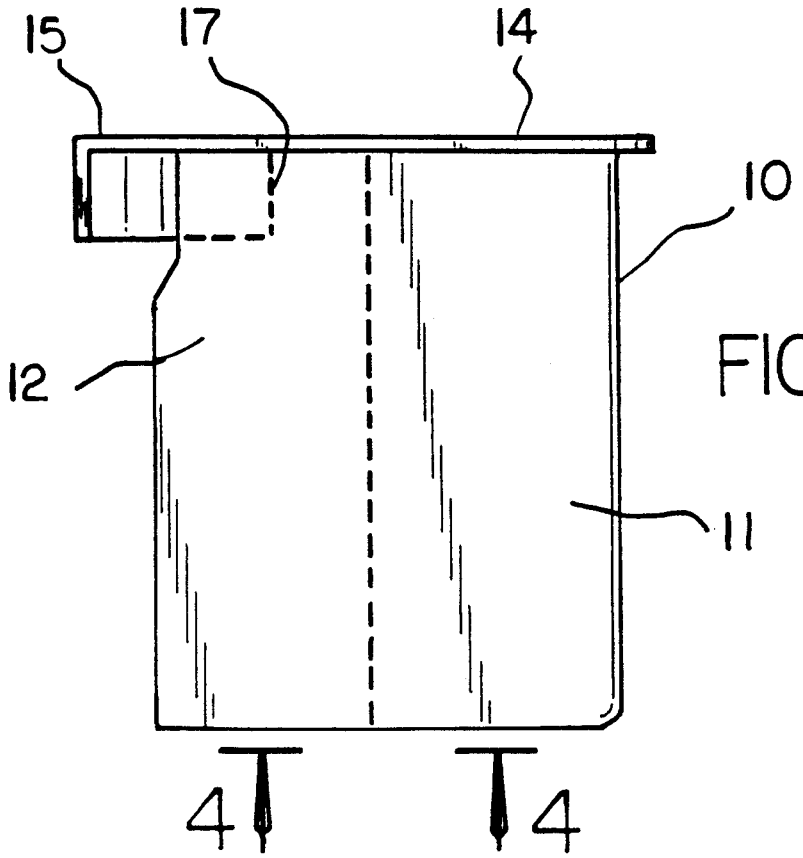
FIG. 3 is a side plan view of the device in FIG. 2.

With reference now to the drawings, and in particular to FIG. 1 thereof, a new and improved paint brush caddy embodying the principles and concepts of the present invention and generally designated by the reference numeral 10 will be described.

More specifically, it will be noted that the basic caddy of the present invention 10, comprises a container body 11 of generally rectangular configuration with an arcuate side 12 thereof adapted to approximately conform to the curvature of a cylindrical paint bucket 13 (shown in broken lines). Extending around the upper portion of the container body 11 is a flat lip 14 extending outwardly from the walls of the container body 11. The lip 14 above the arcuate side 12 is divided into two portions 15 and 16 by a slot 17 extending downwardly therethrough. This slot 17 is of such a width as to permit the bail 18 of the paint bucket 13 to extend therethrough to prevent tipping of the bucket in use. These features are similarly shown in the perspective view of FIG. 2 which shows the inner edge of lip portions 15 and 16 extending downwardly as at 16A to provide for gripping the lip of the paint bucket 13.

FIG. 3 shows a side plan view of the caddy 10 again showing the container body 11, arcuate side thereof 12, lip 14, portion 15 of the inner lip and, in dotted lines, the slot 17 therein.

Figure 4:
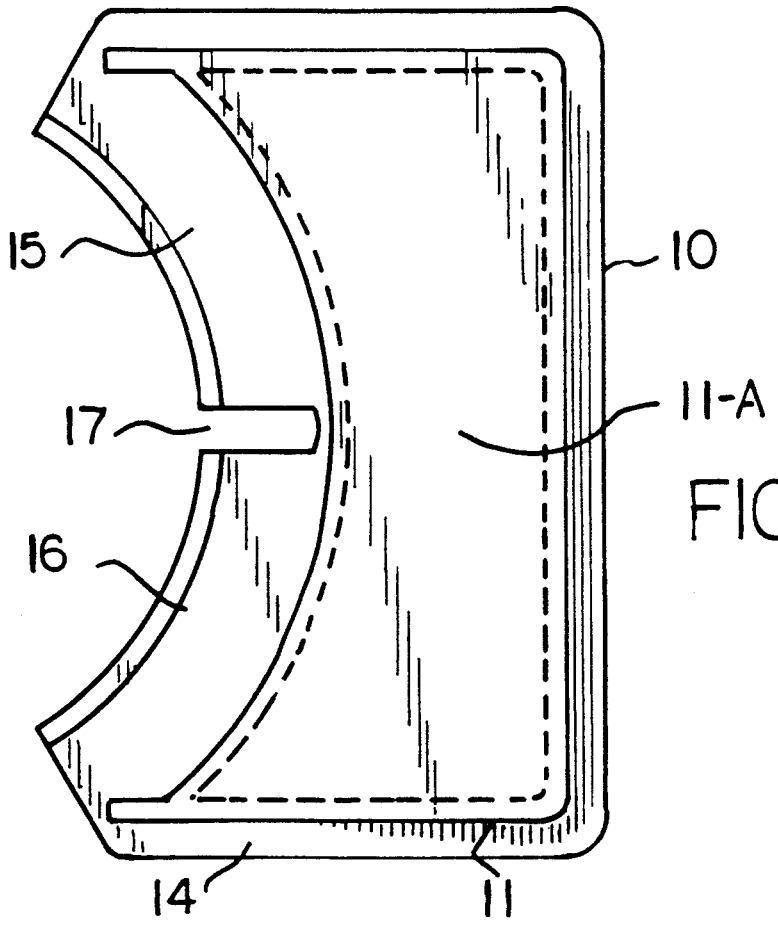
FIG. 4 is a view from the bottom of the device as indicated by 4—4 in FIG. 3.

FIG. 4 shows a bottom plan view of caddy 10 illustrating in dashed lines the paint brush holding portion 11A of container body 11, the lip 14 and the two arcuate portions of the lip 15 and 16 separated by slot 17.

Figure 5:
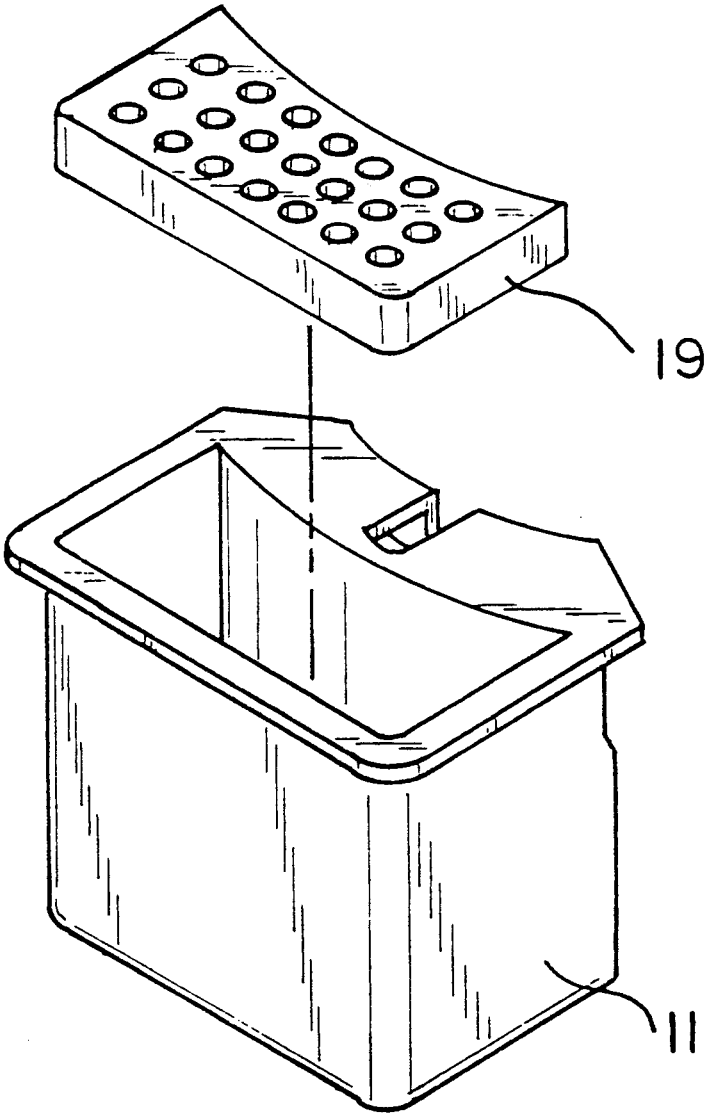
FIG. 5 is a perspective view of a modification of the device of FIG. 2 showing a removeable perforated insert at the base thereof.

In FIG. 5, the addition of a loose fitting perforated grate 19 to the base of container body 11 is shown. This grate 19 is slideably removable from the container body 11 and the perforations therein permit any residue to pass therethrough and to settle to the bottom of container body 11 thus keeping the paint brush clean.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved paint brush caddy for attachment to the lip of a paint bucket having a carrying bail thereon which comprises an open-topped rectangular container having one side thereof curved to conform to the curvature of a paint bucket; a flat lip member extending around the upper portion of said container and extending outwardly therefrom; a slot extending downwardly through said lip member above the curved side of said container to divide said lip into two portions, each of said portions having at its outer edge a downwardly extending lip to engage with the lip of a paint bucket, said slot being adapted to engage with and hold therein the bail of a paint bucket.

2. A paint brush caddy as in claim 1 wherein a removeable perforated grate is inserted in the bottom portion of said container.

* * * * *